United States Patent [19]

Robbins et al.

[11] 4,382,508

[45] May 10, 1983

[54] PACKAGING AND ENVIRONMENTAL TREATMENT CONTAINER SYSTEM

[75] Inventors: Roberta Robbins, Sherman Oaks; William E. Henson, North Hollywood, both of Calif.

[73] Assignee: American Western Industries, Inc., North Hollywood, Calif.

[21] Appl. No.: 236,931

[22] Filed: Feb. 23, 1981

[51] Int. Cl.[3] ..... B65D 69/00; B65D 85/67; B65D 21/02

[52] U.S. Cl. ..... 206/216; 206/315 R; 206/226; 206/229; 206/514; 206/45.34

[58] Field of Search ..... 206/216, 225, 226, 229, 206/315, 514, 577, 579, 38, 45.34; 220/8, 23; 239/333; 222/321

[56] References Cited

U.S. PATENT DOCUMENTS 3,485,502 12/1969 Thornton ..... 15/104.93

*Primary Examiner*—William T. Dixson, Jr.
*Assistant Examiner*—Brenda J. Ehrhardt
*Attorney, Agent, or Firm*—Poms, Smith, Lande & Rose

[57] ABSTRACT

A fabric member is stored in a transparent tube having a spray bottle of treatment fluid as one airtight end closure and a vial of paste or solid adjunct material as the other airtight end closure. Together, the tube, vial and bottle define a storage, environmental control and treatment container for the fabric member, particularly an athletic glove. In a second embodiment, a removable airtight end cap is substituted for the vial.

6 Claims, 1 Drawing Figure

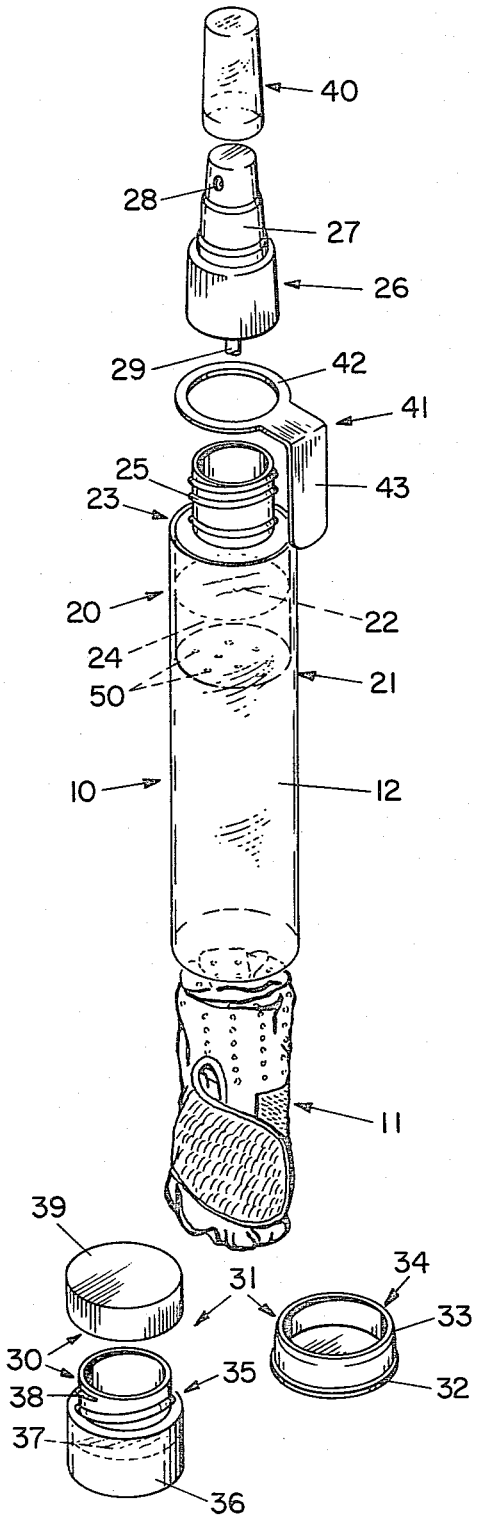
40
28
27
26
29
42
41
25
43
23
20
22
24
21
50
10
12
11
39
34
31
33
30
35
38
32
37
36

PACKAGING AND ENVIRONMENTAL TREATMENT CONTAINER SYSTEM

This invention relates generally to multiple function containers. More specifically, the invention discloses a container and system for the combined functions of point-of-sale packaging, chemical treatment and environmental control, and is particularly applicable to athletic gloves.

BACKGROUND OF THE INVENTION

Athletic gloves are used in a variety of sports, particularly sports such as golf, racketball, tennis and the like that utilize a club or racket. The gloves designed for these applications are typically constructed of leather, cloth, or synthetic materials that simulate leather. These gloves are designed to improve the athlete's grip on a club or racket while minimizing abrasion and blistering of the athlete's hand.

One adjunct frequently used with athletic gloves is a substance that may be applied to the club or racket contacting surface of the glove to increase the adhesion therebetween and thus avoid slippage of the athlete's grip on the club or racket. One such material is beeswax which can be applied to the palm and finger surfaces of the glove which contact the golf club, for example.

Chemical treatments are also available which may be applied directly to the glove surface, sprayed thereon or included in the storage environment of the glove for softening and treating the leather and other portions of the glove. These chemical treatments and conditioners inhibit drying out and cracking of the glove material thereby increasing the glove's useful life.

Finally, gloves may be sold in point-of-sale display packages that are either disposable or reusable. Chemical treatment supplies or adjuncts usually have been sold separately. Prior to the present invention, no way was known for conveniently packaging an athletic glove in a convenient reusable container that also included chemical storage and environmental treatment arrangements.

Accordingly, it is a major object of the present invention to disclose and provide a unitary and compact container for the combined functions of point-of-sale display of an athletic glove, storage of said glove throughout its useful life, chemically treating said glove, and storing chemical treatment substances for use with said glove.

It is also an object of the present invention to disclose and provide a container that serves as a field treatment environment for the glove and wherein a portion of that container is in itself a container for storage of a treatment chemical.

It is a further object of the present invention to disclose and provide an athletic glove storage container that has a conveniently accessable container for the storage of beeswax or other adjunct materials for use with the glove.

It is a still further object of the present invention to disclose and provide a container which accomplishes the foregoing functions and which is, as well, lightweight, compact, aesthetically pleasing, and effective as a point-of-sale packaging container.

It is yet a further object of the present invention to disclose and provide a container having a simplicity of construction and which is constructed of inexpensive materials, thereby minimizing cost.

SUMMARY OF THE INVENTION

Briefly, a container system which meets the above objectives as well as providing many additional features and advantages is basically comprised of a transparent tube and two end closures, at least one of which is a cylindrical spray container for treating the glove or other flexible member to be stored in the tube.

More specifically, one preferred illustrative embodiment of the present invention comprises: a tube constructed of transparent plastic and extending several inches in length; a first container of a cylindrical shape and having a threaded cap for the containment and storage of beeswax for use as an adjunct treatment of an athletic glove, said container being shaped to functionally fit onto one end of said tube and serve as a cap thereof; and a second container of cylindrical shape and having a spray plunger pump apparatus in the top thereof for containing, storing, and spraying a chemical treatment fluid which is useful for extending the life and improving the performance of the glove, said second container fitting onto the other end of said tube and serving as a second cap thereof; whereby each of said containers may be operably fitted as a cap on each end of said tube, thereby defining an airtight cylindrical container for the storage of an athletic glove and which also controls the chemical vapour environment of said glove during storage.

As will appear, this container functionally operates as three containers which, together, effectively contain all items relating to an athletic glove and its treatment for use. An athletic glove in such a container would not require any other materials or preparations to be carried separately. In this manner all treatment adjuncts are contained therein in one convenient and accessable location.

Other objects, features and advantages of the present invention may be more fully understood from a consideration of the drawings and of a detailed description of a preferred embodiment, as follows.

BRIEF DESCRIPTION OF THE DRAWINGS

The single FIGURE of the drawings is an exploded perspective view of an athletic glove container system illustrating the present invention.

DETAILED DESCRIPTION OF A PREFERRED EMBODIMENT

In its preferred embodiment, the present invention comprises a system of containers. Said system includes a principal container 10 and one or more subsidiary containers 20 and 30, the principal container 10 being designed and adapted for the point-of-sale display and storage of an athletic glove, notably a golf glove 11. The principal container 10 defines a volume sufficient to contain and store a golf glove 11 and maintains that volume in a sealed and airtight manner whereby a golf glove stored therein has a controlled atmospheric environment. Such a controlled environment allows vapours of chemicals deposited on said glove and used in the treatment or conditioning of the glove to be retained proximate said glove throughout the period of storage.

The principle container 10 is defined by a tube 12 and cap structures 21 and 31 for each end of said tube 12, as will be further defined. Said tube 12 is formed of transparent plastic material and, for ease of construction and use, has a circular cross-section. The thickness of the plastic wall of said tube is sufficient to provide structural rigidity. The tube 12 may be several inches in length and is of diameter sufficient for a golf glove 11 to be inserted therein. Said tube has closure means or cap structures 21 and 31 at each end thereof which close and define the principle container 10 which has a predetermined volume.

The first of said closure means comprises the first subsidiary container 20 for the storage and dispensing of a chemical treatment fluid 22. In the preferred embodiment, said container comprises a spray cap bottle 23 of predetermined circular external cross-section substantially corresponding with the internal circular cross-section of said tube 12. Said bottle 23 has a cylindrical fluid storage portion 24 and a threaded protrusion 25 which extends from one end of said cylindrical portion 24 and on which a threaded screw-on type cap may be placed. A screw-on spray cap 26 is provided having a plunger-type spray nozzle and pump as is known in the art. Said plunger-type spray nozzle and pump comprises a depressable plunger pump portion 27, atomizing nozzle orifice 28, and a pump intake tube 29 extending from the plunger into the bottle 23. Said spray cap 26 is threaded and designed to be screwed onto the threaded protrusion 25 of said bottle 23 thereby defining a sealed container for the storage of a fluid, particularly a liquid conditioning agent or chemical treatment 22 for use with athletic gloves.

In use, depression of the plunger pump portion 27 draws fluid 22 from the bottle 23 through the pump intake tube 29 and propels said fluid 22 through the atomizing nozzle orifice 28 where the fluid 22 is atomized, sprayed, dispensed and deposited on an athletic glove positioned proximate said orifice 28.

A plunger protective cap 40 is provided which fits over, is frictionally held in place on, and selectively removeable from, the plunger portion 27 of said spray cap 26 thereby preventing inadvertent depressing of the plunger 27 and dispensing of treatment fluid 22.

Incidentally, the fluid within container 20 may include known liquids suitable for treating leather or similar fabrics, including glycerine, lemon oil, and suitable solvents and extenders.

The cylindrical portion 24 of said first subsidiary container 20 is of predetermined external diameter substantially corresponding with the internal diameter of said tube 12 whereby said subsidiary container 20 may be inserted into one end of said tube 12 and be retained in place therein by close frictional contact therebetween. In this manner, said subsidiary container 20 defines an airtight closure of one end of the tube 12. Suitable adhesive material may be applied to the plastic spray bottle 23 prior to assembly to the upper end of tube 12 to firmly hold these two components in their assembled positions.

The second of said closure means comprises a cap structure 31 which has a circular disk portion 32 having a diameter slightly larger than the internal diameter of said tube 12, and a short tubular protrusion 33 on one side of said disk portion 32 and concentric therewith. The tubular protrusion 33 has a predetermined external diameter substantially corresponding with the internal diameter of said tube 12 whereby said cap structure 30 may be inserted into the end of said tube 12 and be retained in place by close frictional contact between the external surface of the tubular portion 33 of said cap structure 31 and the internal surface of the end of said tube 12. The circular disk portion 32 of said tube 12 functions as a flange preventing said cap structure 31 from being inserted too far into the end of tube 12 and facilitates manual removal of said cap structure 31 from the end of tube 12. Together, said tubular protrusion 33 and the disk portion 32 of cap structure 31, when positioned on the end of tube 12, function as an airtight closure of said tube 12 and define another end of said principle container 10.

Alternatively, the second, lower closure means may be comprised of a second subsidiary container 30. This second subsidiary container 30 includes a vial 35 having a substantially cylindrical portion 36 for the storage of an adjunct material such as beeswax 37 for use with the golf glove 11. Said vial 35 is provided with a threaded protrusion 38 extending from one end of said cylindrical portion 36 and on which a screw-on type cap may be placed. A screw-on cap 39 is provided having a circular cross-section of a predetermined external diameter substantially corresponding with the internal diameter of said tube 12. Said cap 39 is internally threaded and designed to be screwed onto the threaded protrusion 38 of the vial 35 thereby defining a sealed container for the storage of the adjunct material 37 for use with said golf glove 11. The cylindrical portion 36 of the vial 35 has an external diameter slightly larger than the internal diameter of said tube 12. Together, the vial 35 and cap 39 constitute a lower closure structure 31 whereby said cap 39 may be inserted into the end of said tube 12 and be retained in place by the frictional contact between the external surface of said cap 39 and the internal surface of the end of said tube 12, whereby said cap defines an airtight closure for said tube 12. The cylindrical portion 36 of vial 35 functions as a flange and prevents said second subsidiary container 30 from being inserted too far into tube 12 and also facilitates removal thereof. In operation, cap structure 31 comprised of said vial 35 and cap 39 defines the lower closure of said principle container 10.

In an alternative embodiment of the second subsidiary container 30, including vial 35 and screw-on cap 39 as previously described, said cap 39 may alternatively be provided with a variation in diameter along its length, said diameter substantially corresponding with the internal diameter of said tube 12, whereby said cap 39 may be inserted into the end of said tube 12 a predetermined distance which causes a predetermined frictional contact between the external surface of cap 39 and the internal surface of the end of said tube 12 defining an airtight closure of said tube 12. The increased diameter portion of cap 39 may function either as an increasing diameter taper preventing second subsidiary container 30 from being inserted too far into tube 12 or as a flange which accomplishes the same function.

The foregoing elements, when assembled together, comprise a principle container 10 for the storage of an athletic glove 11. Said container 10 is defined by the internal surface of said tube 12, the first subsidiary container 20, functioning as first cap structure 21 by being inserted into and frictionally or adhesively retained in one end of said tube 12 and thereby defining an airtight closure thereof, and second cap structure 31, alternatively comprising an end cap 34 or vial 35 and cap 39 and funtioning as second cap structure 31 by being inserted into the other end of tube 12 and thereby defining an airtight closure thereof, whereby the space within said tube 12 and extending between the spray container 24 and the vial cap 39 or end cap 34 defines the storage space and controlled atmospheric environment for the athletic glove 11.

If desired, tiny perforations 50 may be provided in the bottom of container 23 by piercing it with a needle or the like to insure continued treatment of the glove 11 despite prolonged storage.

The principle container 10 may be further provided with a retainer clip 41 which may function as a hanger for mounting the foregoing container system on a point-of-sale display. Alternatively, said clip may clip or hang the foregoing container on a golf bag. Said retainer clip 41 is comprised of a ring portion 42 which has an internal diameter of a size sufficient to allow said ring portion 42 to be placed over and be positioned on said threaded protrusion portion 25 of said treatment fluid bottle 23 whereby placement of said ring portion between said bottle 23 and its screw-on cap 26 fixedly positions and retains said ring portion therebetween. Said retainer clip 41 is further provided with a clip portion 43 integral with and extending from ring portion 42 which is disposed at an angle from the planar aspect of said ring portion 42 such that said clip portion 43 may act as a hanger and thereby carry the foregoing container system.

In use, the transparent wall of the tube portion 12 of the container 10 will allow the athletic glove 11 to be seen inside and thus serves as an effective point-of-sale display. The spray bottle 23 retains a fluid conditioner or treatment chemical 22 for treating or conditioning the material or fabric of said glove 11. After atheletic use of the glove 11, the plunger protective cap 40 may be removed and the plunger pump 27 depressed to dispense, atomize, and deposit a quantity of said treatment fluid 22 onto the surface of said glove 11. The glove 11 may then be rolled and inserted into the tube 12 and both cap structures 21 and 31 may be placed in position on the ends of the tube 12 thereby allowing the treatment fluid 22 to partially evaporate from the glove surface but be retained within a fixed environmentally controlled area within said principle container 10 such that the vapours of said treatment fluid 22 make contact with and are held proximate to substantially all surfaces of said glove 11.

The end cap 34 or the vial of beeswax 35 may be easily removed from and replaced on the end of said tube 12 thereby allowing easy access to either the glove 11 or the vial of beeswax 35. By this method, the treated glove 11 may be withdrawn from the tube 12, the vial 35 opened and a quantity of beeswax or other adjunct material 37 may be applied to the palm and finger surfaces of glove 11, thereby preparing it for athletic use. With the glove 11 removed from the tube 12, the vial 35 may be reinserted in the tube 12, thereby retaining all adjuncts being used with said athletic glove 11 in a unitary and convenient storage condition and location.

In one illustrative embodiment, said tube 12 is formed of transparent plastic material having a thickness of 0.032 inch, a diameter of 1.375 inches, and a length of 5.5 inches. Cylindrical storage portion 24 of the spray cap bottle 23 has a length of 1.5 inches and a diameter substantially equal to the inside diameter of said tube. The overall length of spray bottle 23 with spray cap 26 and plunger protective cap 40 in an assembled condition is 4 inches. The vial 35 has a diameter substantially corresponding with the inside diameter of tube 12 and has an overall length of the cylindrical portion 36 and the screw-on cap 39 in an assembled condition of 1.25 inches. The screw-on cap 39 has a length of 0.4 inch. In this manner, the principle container 10, with both closure means in place, defines a cylindrical storage volume with a length of 3.5 inches and a diameter of 1.32 inches.

Although the container and treatment system as described above was primarily intended for use with golf gloves, it could also be used for other applications. For specific example, for musicians, such as trombone players, it is desirable to have a cloth available for applying fluids to their instruments; and in the case of trombones, a wiping cloth could be contained in the central part of the container, principle container 10, of the present invention, water in the spray container 23, and trombone slide cream in the second smaller container, vial 35. It is further contemplated that the present multiple purpose containers could have other applications, apart from the treatment or preservation of golf gloves, which is the primary and preferred application for the present invention.

Although this invention for an improved storage container system has been described in detail, it is to be understood that various modifications thereof can be made by one skilled in the art and still come within the scope and spirit of the present invention which is only limited as defined by the following claims.

What is claimed is:

1. A combined point-of-sale, and atmospheric environmental control storage package and assembly for a golf glove, comprising:

a thin, semi-rigid, bendable, cylindrical, transparent plastic tube several inches in length, for enclosing the golf glove and retaining a preservative and conditioning atmosphere around the glove;

a cylindrical spray container for glove conditioning and preserving fluid, fitting within said tube to form an upper airtight closure for said tube, said container extending into said tube for less than one-third of the length of said tube;

spray fluid means for conditioning and preserving gloves, in said spray container;

said spray container making a tight fit within one end of said tube, with the outer diameter of said spray container closely fitting the inner diameter of said tube;

means for hermetically sealing said spray container to said tube;

an airtight lower closure for said plastic tube; and a golf glove enclosed within said tube between said spray container and said airtight closure.

2. A combined point-of-sale and atmospheric environmental control package and assembly as defined in claim 1 wherein said lower closure is a container of beeswax tightly fitting into the lower end of said tube.

3. A combined point-of-sale and atmospheric environmental package and assembly as defined in claim 1 wherein said spray container includes a threaded spray attachment, and further comprising:

retaining clip means for securing said assembly to a point-of-sale advertising display, to a golf bag or to any other desired location.

4. An assembly as defined in claim 3, wherein means including an aperture in said retaining clip means, are provided for holding said clip under said threaded spray attachment.

5. An assembly as defined in claim 2, wherein cementing means are provided for securing said spray container in one end of said plastic tube, and wherein said beeswax container has a reduced diameter cap fitting tightly into the other end of the said tube, and an enlarged body portion for engaging the lower end of said tube when the a container of paste or solid material is closed.

6. An assembly as defined in claim 1 wherein said plastic tube is about five and one-half inches in length and one and one-third inches in diameter and said spray container and said container of paste or solid material extend into the respective ends of said plastic tube to form airtight closures which define a storage space having a length of approximately three and one-half inches.

* * * * *